US009117414B2

(12) United States Patent
Jun et al.

(10) Patent No.: US 9,117,414 B2
(45) Date of Patent: Aug. 25, 2015

(54) DISPLAY APPARATUS AND METHOD OF DRIVING THE SAME

(71) Applicant: Samsung Display Co., Ltd., Yongin, Gyeonggi-Do (KR)

(72) Inventors: Tae-Jong Jun, Suwon-si (KR); Jongseo Lee, Hwaseong-si (KR); Jooyoung Lee, Seoul (KR); Soo-Lin Kim, Seoul (KR); Jung-Suk Han, Hwaseong-si (KR)

(73) Assignee: SAMSUNG DISPLAY CO., LTD. (KR)

( * ) Notice: Subject to any disclaimer, the term of this patent is extended or adjusted under 35 U.S.C. 154(b) by 0 days.

(21) Appl. No.: 14/197,431

(22) Filed: Mar. 5, 2014

(65) Prior Publication Data

US 2014/0184666 A1 Jul. 3, 2014

Related U.S. Application Data

(62) Division of application No. 12/620,000, filed on Nov. 17, 2009, now Pat. No. 8,704,749.

(30) Foreign Application Priority Data

May 28, 2009 (KR) ..... 10-2009-0047093

(51) Int. Cl.

| | |
|---|---|
| ***G09G 3/36*** | (2006.01) |
| ***G09G 3/34*** | (2006.01) |
| ***G09G 5/02*** | (2006.01) |
| *G09G 5/10* | (2006.01) |

(52) U.S. Cl.

CPC ..... *G09G 3/36* (2013.01); *G09G 3/3406* (2013.01); *G09G 3/3648* (2013.01); *G09G 5/02* (2013.01); *G09G 3/3607* (2013.01); *G09G 5/10* (2013.01); *G09G 2320/064* (2013.01); *G09G 2320/0646* (2013.01)

(58) Field of Classification Search

None

See application file for complete search history.

(56) References Cited

U.S. PATENT DOCUMENTS

| | | | | |
|---|---|---|---|---|
| 2003/0234778 | A1 | 12/2003 | Kim | |
| 2007/0040797 | A1* | 2/2007 | Shih et al. | 345/102 |
| 2009/0009464 | A1 | 1/2009 | Kohashikawa et al. | |
| 2010/0295877 | A1 | 11/2010 | Yun | |

FOREIGN PATENT DOCUMENTS

| | | | |
|---|---|---|---|
| JP | 2005094247 | A | 4/2005 |
| JP | 2007104722 | A | 4/2007 |
| JP | 2008283446 | A | 11/2008 |
| KR | 1020080026111 | A | 3/2008 |
| KR | 1020090046200 | A | 5/2009 |
| WO | 2007099472 | A1 | 9/2007 |
| WO | 2009061107 | A2 | 5/2009 |

* cited by examiner

*Primary Examiner* — Joseph Haley
*Assistant Examiner* — Ifedayo Iluyomade
(74) *Attorney, Agent, or Firm* — Cantor Colburn LLP

(57) ABSTRACT

A display apparatus includes a display panel which receives a light, a backlight which provides the light to the display panel in response to a driving voltage, and a backlight driver which applies the driving voltage to the backlight. The backlight is turned on and off during a communication period to transmit data to an external receiver using visible light communication during the communication period. The backlight driver controls a voltage level of the driving voltage according to a number of turn-on periods of the driving voltage during the communication period.

16 Claims, 9 Drawing Sheets

DISPLAY APPARATUS AND METHOD OF DRIVING THE SAME

This application is a divisional of U.S. patent application Ser. No. 12/620,000, filed on Nov. 17, 2009, which claims priority to Korean Patent Application No. 10-2009-0047093, filed on May 28, 2009, and all the benefits accruing therefrom under 35 U.S.C. §119, the content of which in its entirety is herein incorporated by reference.

BACKGROUND OF THE INVENTION (1) Field of the Invention

The present invention relates to a display apparatus. More particularly, the present invention relates to a display apparatus which transfers data using visible light communication and having substantially improved display quality.

(2) Description of the Related Art

A liquid crystal display typically includes two substrates and a liquid crystal layer interposed between the two substrates. A transmittance of light passing through the liquid crystal layer is controlled to display an image. However, the liquid crystal display is a non-emissive type of display device, and therefore requires a separate light source, such as a backlight unit, for example.

The backlight unit generally includes a backlight having light sources, and a driver which drives the backlight to provide the liquid crystal display with light to display the image.

BRIEF SUMMARY OF THE INVENTION

Exemplary embodiments of the present invention include a display apparatus having advantages that include, but are not limited to, substantially improved display quality, e.g., reduced flicker and/or uniform brightness, while transferring data using visible light communication.

In an exemplary embodiment of the present invention, a display apparatus includes a display panel which receives a light, a backlight which provides the light to the display panel in response to a driving voltage, and a backlight driver. The backlight is turned on and off during a communication period to transmit data to an external receiver using visible light communication during the communication period, while the backlight driver controls a voltage level of the driving voltage according to a number of turn-on periods of the driving voltage during the communication period, and supplies the driving voltage to the backlight.

An exemplary embodiment includes a plurality of communication periods, and the light provided to the display panel during two or more communication periods of the plurality of communication periods has a uniform brightness over the two or more communication periods.

The backlight driver compares the number of turn-on periods of the driving voltage in each communication periods of the two or more communication periods with a reference number to control the voltage level of the driving voltage with respect to a predetermined reference voltage.

In an exemplary embodiment, the backlight driver increases the voltage level of the driving voltage to be greater than a voltage level of the reference voltage in a given communication period of the two or more communication periods when the number of turn-on periods in the given communication period is less than the reference number, and decreases the voltage level of the driving voltage to be less than the voltage level of the reference voltage when the number of turn-on periods of the given communication period is greater than the reference number.

The backlight driver controls the voltage level of the driving voltage such that the voltage level of the driving voltage is inversely proportional to a duty ratio of the turn-on periods during the communication period.

In an alternative exemplary embodiment of the present invention, a display apparatus includes a display panel which receives a light, a backlight which provides the light to the display panel in response to a first driving voltage and a second driving voltage, and a backlight driver. The backlight includes a first light source that is turned on and off during a communication period to transmit data to an external receiver using visible light communication during the communication period, and a second light source that compensates a brightness of the first light source. The backlight driver controls the second driving voltage according to the number of turn-on periods of the first driving voltage during the communication period, and supplies the second driving voltage to the second light source.

The first driving voltage has a frequency that is different from a frequency of the second driving voltage.

The backlight driver compares the number of turn-on periods of the first driving voltage in the communication period with a reference number to control a time duration of a turn-on period of the second driving voltage.

The backlight driver receives information corresponding to an amount of light emitted from the first light source from an external source to control the second driving voltage.

The backlight driver controls a voltage level of the second driving voltage such that the level of the second driving voltage is inversely proportional to a duty ratio of the turn-on periods of the first driving voltage during the communication period.

In another alternative exemplary embodiment of the present invention, a display apparatus includes a display panel which receives a light, a backlight and a backlight driver. The backlight provides the light to the display panel in response to a driving voltage, and is turned on and off during a communication period to transmit data to an external receiver using visible light communication during the communication period. The communication period includes a data period, during which the data is transmitted, and a brightness compensation period, during which a brightness is compensated. The backlight driver controls the driving voltage during the brightness compensation period according to a number of turn-on periods of the driving voltage in the data period, and supplies the driving voltage to the backlight.

The backlight driver compares the number of turn-on periods of the driving voltage in the data period with a reference number to control a time duration of a turn-on period of the driving voltage in the brightness compensation period.

In yet another alternative exemplary embodiment of the present invention, a display apparatus includes a display panel which receives a light, a backlight which provides the light to the display panel in response to a driving voltage and a backlight driver. The backlight is turned on and off during a communication period to transmit data to an external receiver using visible light communication during the communication period. The backlight driver drives the backlight during the communication period in either a first mode, during which the driving voltage has a first duty ratio, or in a second mode, during which the driving voltage has a second duty ratio that is less than the first duty ratio. The backlight driver controls a voltage level of the driving voltage such that the voltage level of the driving voltage is inversely proportional to the second duty ratio of the second mode.

In still another alternative exemplary embodiment, in a method of driving a display apparatus including a display panel, a backlight and a backlight driver, the method includes: providing light to the display panel from the backlight in response to a driving voltage; turning the backlight on and off during a communication period to transmit data to an external receiver using visible light communication during the communication period; and controlling a voltage level of the driving voltage with the backlight driver according to a number of turn-on periods of the driving voltage during the communication period.

In still another alternative exemplary embodiment, in a method of driving a display apparatus including a display panel, a backlight having a first light source and a second light source, and a backlight driver, the method includes: providing the backlight to the display panel in response to a first driving voltage and a second driving voltage; turning the first light source on and off during a communication period to transmit data to an external receiver using visible light communication during the communication period; compensating a brightness of the first light source using the second light source; and controlling the second driving voltage according to a number of turn-on periods of the first driving voltage during the communication period.

In yet another alternative exemplary embodiment, in a method of driving a display apparatus including a display panel, a backlight and a backlight driver, the method includes: providing light to the display panel in response to a driving voltage; transmitting data to an external receiver using visible light communication by turning on and off the backlight during a communication period, the communication period including a data period, during which the data is transmitted to the external receiver, and a brightness compensation period, during which a brightness of the light is compensated; and controlling the driving voltage during the brightness compensation period according to a number of turn-on periods of the driving voltage in the data period.

In still another alternative exemplary embodiment, in a method of driving a display apparatus including a display panel, a backlight and a backlight driver, the method includes: providing a light to the display panel in response to a driving voltage; transmitting data to an external receiver using visible light communication by turning on and off the backlight during a communication period; driving the backlight during the communication period in one of a first mode during which the driving voltage has a first duty ratio and a second mode during which the driving voltage has a second duty ratio less than the first duty ratio; and controlling a voltage level of the driving voltage such that the voltage level of the driving voltage is inversely proportional to the second duty ratio.

Thus, a display apparatus according to the exemplary embodiments described herein effectively reduces a brightness difference occurring when data are transmitted during communication periods, thereby substantially improving a display quality thereof. In addition, the display apparatus according to an exemplary embodiment applies a driving voltage having a controlled duty ratio to the backlight, to thereby increase an intensity of the light and a transmission distance of the same.

BRIEF DESCRIPTION OF THE DRAWINGS

The above and other aspects, features and advantages of the present invention will become more readily apparent by describing in further detail exemplary embodiments thereof with reference to the accompanying drawings, in which.

DETAILED DESCRIPTION OF THE INVENTION

Figure 1:
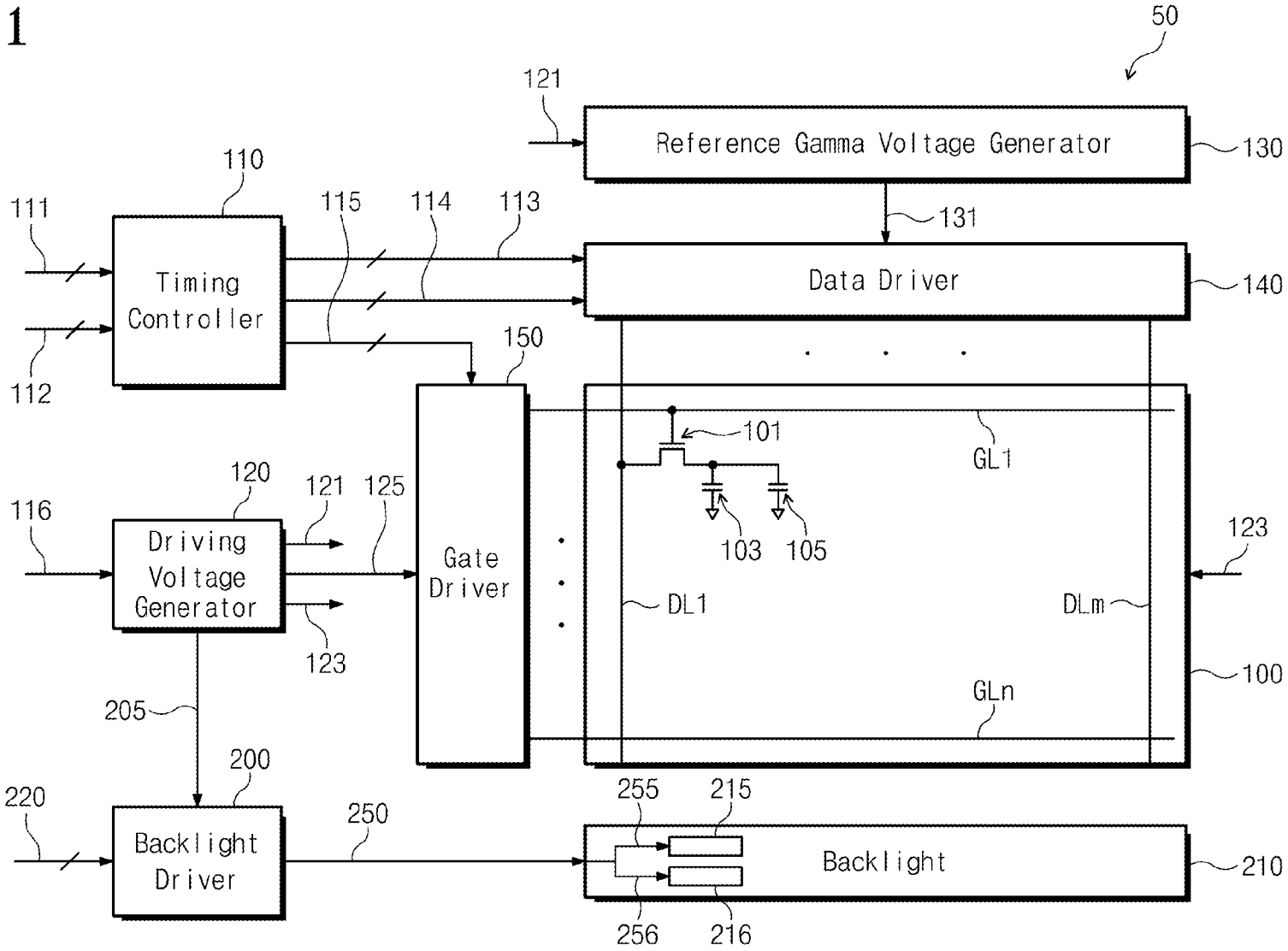
FIG. 1 is a block diagram of an exemplary embodiment of a display apparatus according to the present invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting. As used herein, the singular forms "a," "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, exemplary embodiments of the present invention will be described in further detail with reference to the accompanying drawings.

FIG. 1 is a block diagram of an exemplary embodiment of a display apparatus according to the present invention.

Referring to FIG. 1, a display apparatus 50 according to an exemplary embodiment includes a display panel 100, a timing controller 110, a driving voltage generator 120, a reference gamma voltage generator 130, a data driver 140, a gate driver 150, a backlight 210 and a backlight driver 200.

The display panel 100 receives light to display an image. The display panel 100 includes an upper substrate (not shown), a lower substrate (not shown) disposed opposite to, e.g., facing, the upper substrate, and a liquid crystal layer (not shown) interposed between the upper substrate and the lower substrate. In addition, the display panel 100 includes gate lines GL1-GLn (FIG. 1) that extend along a first direction and are alternately arranged along a second direction, substantially perpendicular to the first direction, data lines DL1-DLm that extend along the second direction and are alternately arranged along the first direction, thin film transistors 101, each of which is connected to a corresponding gate line GL of the gate lines GL1-GLn, and a corresponding data line DL of the data lines DL1-DLm, liquid crystal capacitors 103 connected to the thin film transistors 101, and storage capacitors 105 connected to the thin film transistors 101.

The timing controller 110 receives an external data signal 111 and an external control signal 112. The timing controller 110 generates a data control signal 114 and a gate control signal 115 in response to the external control signal 112. The timing controller 110 provides the data control signal 114 and the gate control signal 115 to the data driver 140 and the gate driver 150, respectively, and converts the external data signal 111 into a data signal 113 and thereafter provides the data signal 113 to the data driver 140.

The driving voltage generator 120 receives an input voltage 116 from an exterior source (not shown) and generates driving signals applied to the display panel 100, the reference gamma voltage generator 130, the gate driver 150 and the backlight driver 200, as shown in FIG. 1. More specifically, for example, the driving voltage generator 120 applies a common voltage 123 to the display panel 100, and applies an analog driving voltage 121 to the reference gamma voltage generator 130. In addition, the driving voltage generator 120 applies a gate voltage 125 to the gate driver 150 and applies a backlight input voltage 205 to the backlight driver 200.

The reference gamma voltage generator 130 generates reference gamma voltages 131 in response to the analog driving voltage 121, and provides the data driver 140 with the reference gamma voltages 131.

The data driver 140 converts the data signal 113 from the timing controller 110 into an analog data voltage in response to the data control signal 114 and the reference gamma voltages 131, and provides the analog data voltage to the display panel 100.

The gate driver 150 generates a gate signal in response to the gate control signal 115 and the gate voltage 125, and applies the gate signal to the gate lines GL1-GLn.

The backlight 210 includes light sources, described in greater detail below with reference to FIGS. 4 and 5, which provide light to the display panel 100. More specifically, for example, the backlight 210 includes light emitting diodes as the light sources, and further includes a light source substrate (not shown) on which the light emitting diodes are disposed. In an exemplary embodiment, the backlight 210 may be a direct-illumination type backlight, in which case the backlight 210 is disposed at a rear portion of the display panel 100 to provide the light to the display panel 100, but alternative exemplary embodiments are not limited thereto. For example, the backlight 210 may be an edge-illumination type backlight, in which case the backlight 210 is disposed adjacent to a side of the display panel 100 and provides the light to the display panel 100 through a light guide plate (not shown) disposed at the rear portion of the display panel 100.

The backlight driver 200 applies a driving voltage 250 and, more particularly, a backlight driving voltage 250, to the backlight 210. The backlight driving voltage 250 applied to the backlight 210 is repeatedly turned on and off to transmit data via a visible light communication method. More particularly, the backlight driver 200 receives data 220 from an exterior source (not shown) and transmitted using the visible light communication method. In an exemplary embodiment, for example, the backlight driver 200 divides the data 220 into blocks and analyzes the data 220 based on the blocks. More specifically, the backlight driver 200 analyzes the data 220, which may be either a "0" or a "1," and compares a number of times the data 220 is "1" with a reference number of times to control the backlight driving voltage 250 based on a difference between the number of times the data 220 is "1" and the reference number of times. Thereafter, the backlight driver 200 applies the backlight driving voltage 250, controlled by the backlight driver 200, to the backlight 210.

The visible light communication method according to an exemplary embodiment of the display apparatus 50 will be now be described in further detail. When the display apparatus 50 outputs a visible light to a receiver to which a light sensor is applied, the receiver receives the visible light and stores and/or outputs data after analyzing the visible light.

The display apparatus 50 turns the backlight 210 on and off at a high frequency, such that a user does not perceive the turning the backlight on and off, to output the data. More specifically, for example, when a conventional display apparatus turns on a backlight to output a signal "1" and turns off the backlight to output a signal of "0," when the data, having the difference described above, e.g., the number of times of "1" is outputted, in comparison with a reference value, a brightness of the light emitted from the backlight may vary, and the user thereby perceives flicker at a low frequency. In an exemplary embodiment, however, an average brightness is uniformly maintained over the blocks set for the visible light communication method, and the user does not perceive the flicker, even though the backlight 210 is turned on and off.

Hereinafter, an exemplary embodiment of a method of driving the backlight 210 to effectively prevent occurrence of flicker while performing the visible light communication discussed above will be described in further detail with reference to FIGS. 1-3.

Figure 2:
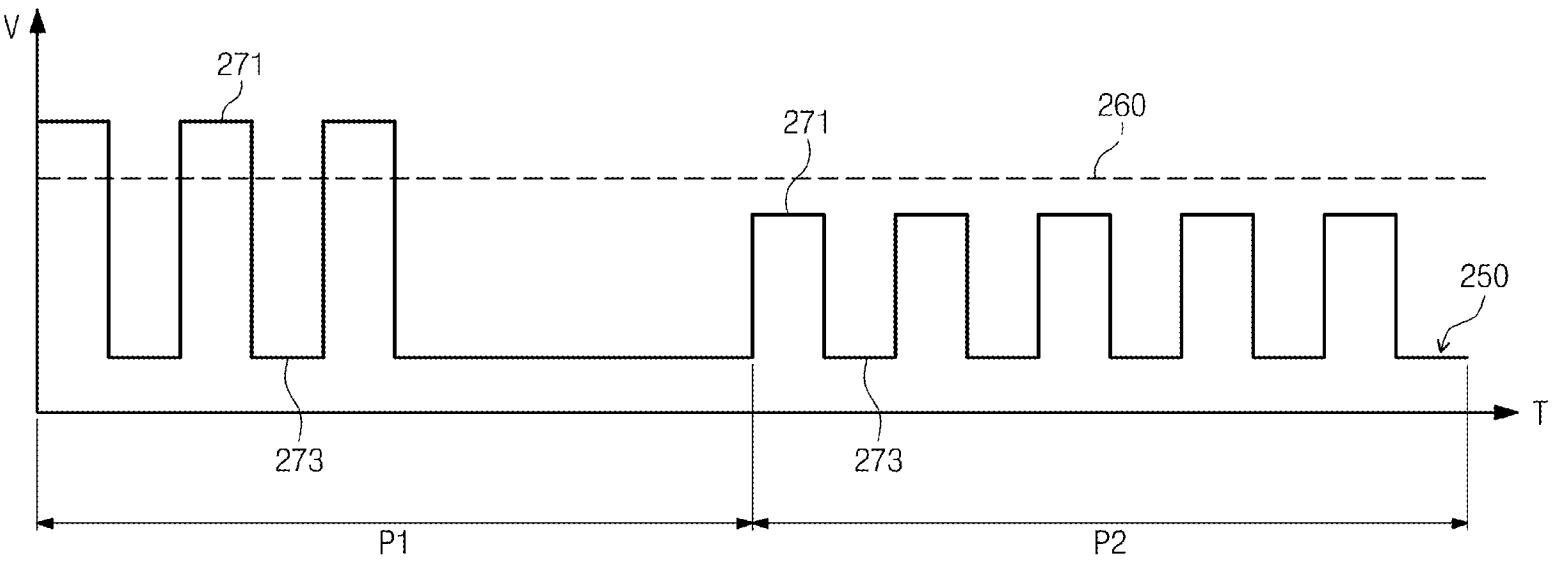
FIG. 2 is a signal timing diagram illustrating an exemplary embodiment of a backlight driving method according to the present invention.
Figure 3:
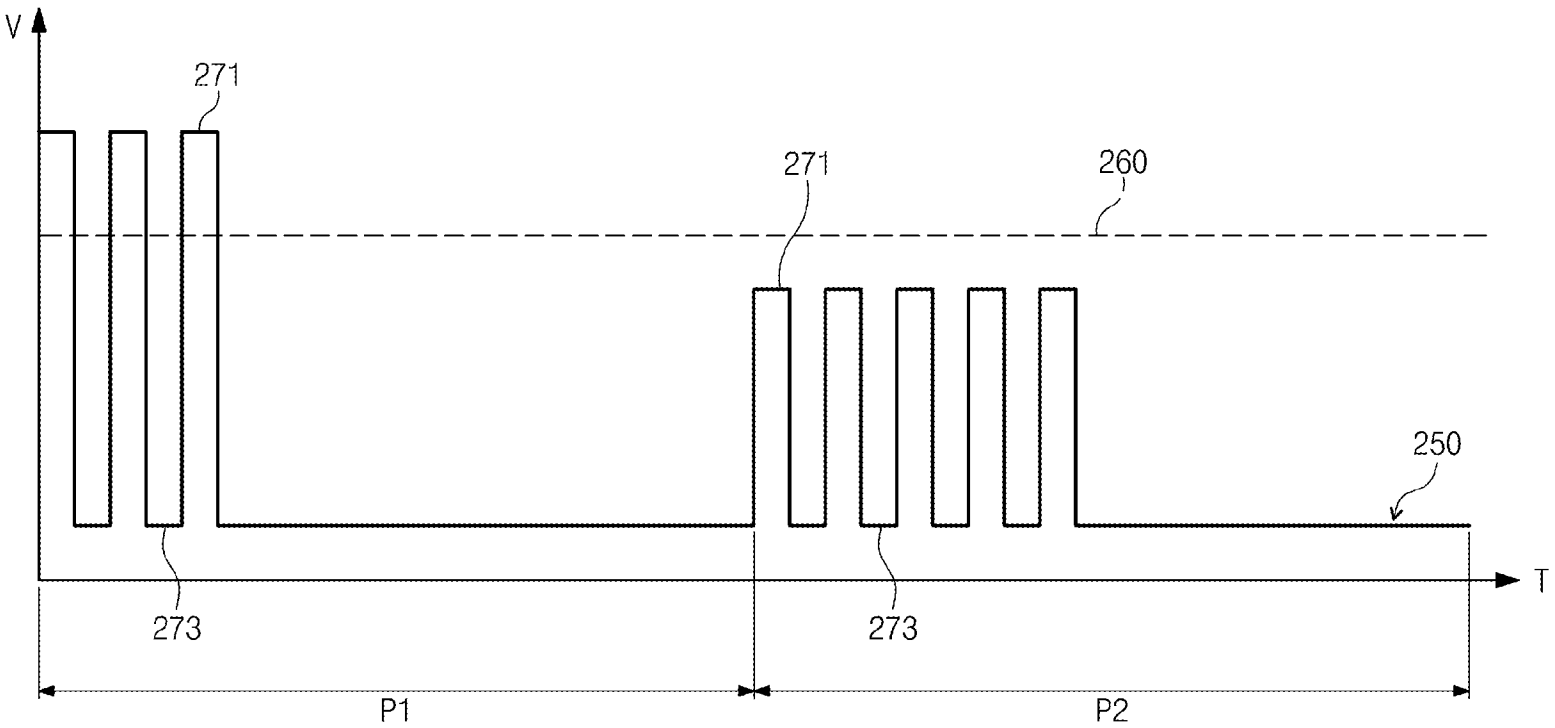
FIG. 3 is a signal timing diagram illustrating a duty ratio of a backlight driving voltage of the backlight driving method shown in FIG. 2.

FIG. 2 is a signal timing diagram illustrating an exemplary embodiment of a backlight driving method according to the present invention, and FIG. 3 is a signal timing diagram illustrating a duty ratio of a backlight driving voltage of the backlight driving method shown in FIG. 2. In FIGS. 2 and 3, the y-axis represents a voltage level V, and the x-axis represents an applying time T of the backlight driving voltage 250.

For visible light communication, a backlight driver 200 (FIG. 1) modulates a backlight driving voltage 250 and provides the backlight driving voltage 250 to a backlight 210. The backlight driver 200 may drive the backlight 210, at a high speed, e.g., a high frequency, using the backlight driving voltage 250, to transmit data, such as data that is not related to information displayed on a display panel 100, to an external receiver (not shown). In an exemplary embodiment, during a communication period, the backlight driving voltage 250 includes turn-on periods 271, during which the backlight 210 is turned on, to generate a first signal, and turn-off periods 273, during which the backlight 210 is turned off, to generate a second signal.

More particularly, the backlight driver 200 drives the backlight 210 to be turned on and/or off in each of a first communication period P1 and a second communication period P2 of the communication period, during which visible light information is communicated to the backlight 210. Specifically, the first communication period P1 and the second communication period P2 indicates a time interval during which data is transmitted by visible light communication.

The backlight driver 200 counts a number of the turn-on periods 271 in each of the first communication period P1 and the second communication period P2. Then, the backlight driver 200 compares the number of the turn-on periods 271 with a reference number, e.g., a reference number of times. In an exemplary embodiment, the reference number of times corresponds to the number of times that the light emitted from the backlight 200 has an average brightness based on a reference voltage 260 during the first communication period P1 and the second communication period P2. The backlight driver 200 controls the voltage level of the turn-on periods 271 such that the backlight 210 emits light having the average brightness in response to the number of the turn-on periods 271 during the first communication period P1 and the second communication period P2. Since light having a brightness lower than the average brightness is emitted from the backlight when the number of the turn-on periods 271 is less than the reference number of times, the backlight driver raises a voltage of each of the turn-on periods 271 by a voltage corresponding to a difference between the number of the turn-on periods 271 and the reference number of times, and provides the raised voltage, which is greater than the reference voltage 260, shown in FIG. 2, to the backlight 210 (FIG. 1). When the number of the turn-on periods 271 is greater than the reference number of times, light having a brightness greater than the average brightness is emitted from the backlight 210, and the backlight driver 200 lowers the voltage of each of the turn-on periods 271 by a voltage corresponding to a difference between the number of the turn-on periods 271 and the reference number of times, and provides the lowered voltage, which is less than the reference voltage 260, as shown in FIG. 2, to the backlight 210. Thus, the backlight driver 200 according to an exemplary embodiment controls the voltage of the turn-on periods 271 during the first communication period P1 and the second communication period P2 using an analog dimming method.

As a result, in the method of driving the backlight 210 according to an exemplary embodiment, the backlight driver 200 reduces a brightness difference occurring when data are transmitted using the visible light communication, during the first communication period P1 and the second communication period P2, thereby effectively preventing visible flicker in the display apparatus 50.

In an exemplary embodiment, as shown in FIG. 3, the backlight driver 200 may control the voltage level of the backlight driving voltage 250 such that the backlight driving voltage 250 is inversely proportional to a duty ratio of the turn-on periods 271 during the first communication period P1 and the second communication period P2. More specifically, for example, when the voltage level of the turn-on periods 271 is set to be a relatively high level, based on the difference between the number of the turn-on periods 271 and the reference number of times, the backlight driver 200 raises the voltage level of the turn-on periods 271 by reducing the duty ratio of the turn-on periods 271. In this case, the reference voltage 260 is set higher, corresponding to the reduction of the duty ratio of the turn-on periods 271. Thus, the light emitted from the backlight 210 and provided to the user is maintained at a uniform brightness during the first communication period P1 and the second communication period P2. In addition, the light emitted from the backlight 210 is provided to the external receiver (not shown) at a high intensity, to thereby substantially increase a transmission distance of the data.

Figure 4:
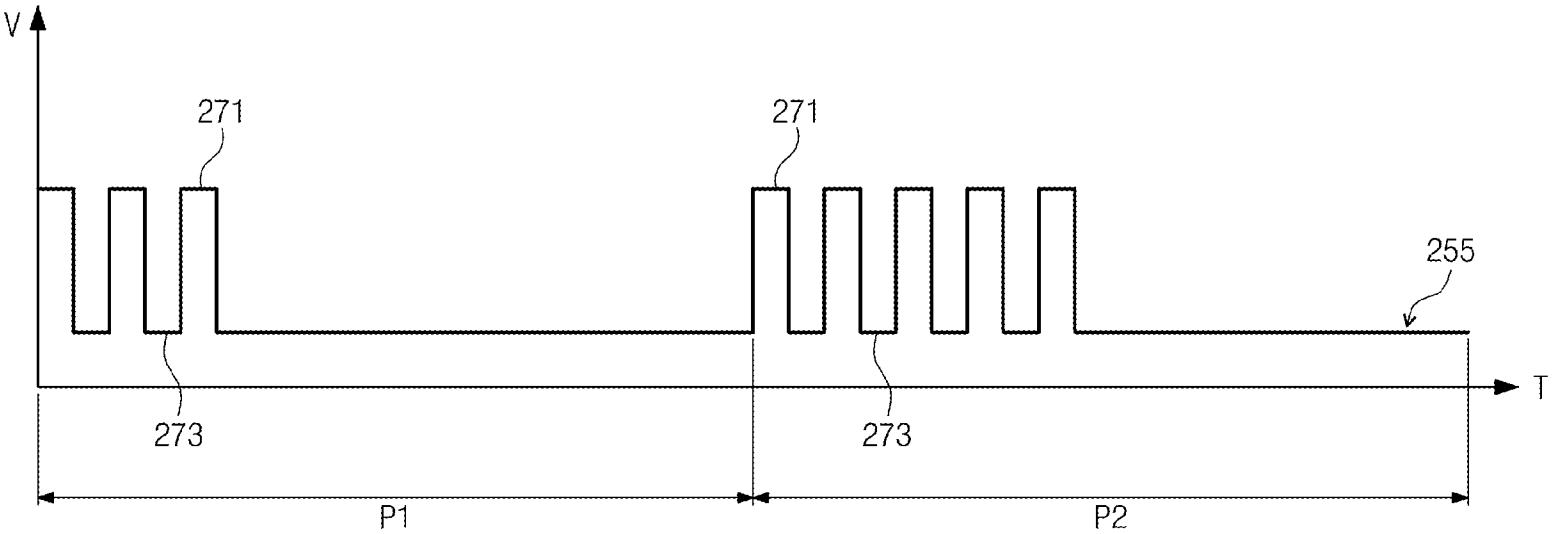
FIGS. 4 and 5 are signal timing diagrams illustrating an alternative exemplary embodiment of a backlight driving method according to the present invention.
Figure 5:
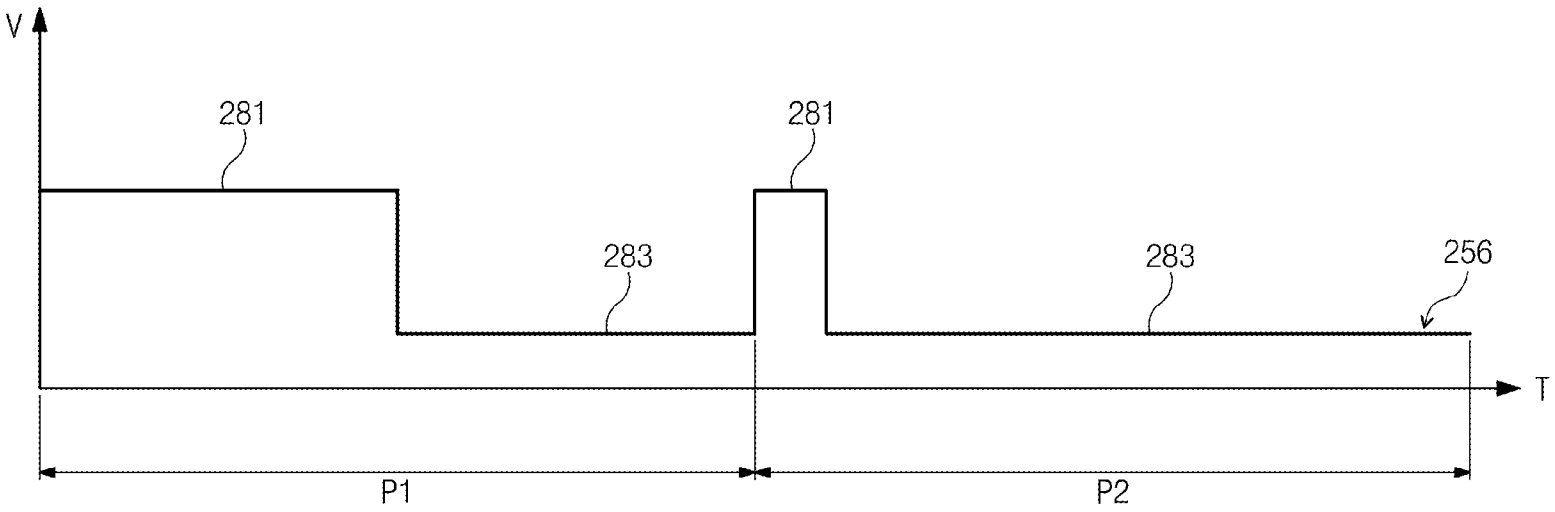

FIGS. 4 and 5 are signal timing diagrams illustrating an alternative exemplary embodiment of a backlight driving method according to the present invention. In FIGS. 4 and 5, a voltage level V and an applying time T of the backlight driving voltage are shown.

Referring to FIGS. 1, 4 and 5, according to an alternative exemplary embodiment, the backlight 210 includes a first light source 215 for transmitting data to an exterior portion of the backlight 210, and a second light source 216 for compensating a brightness of light from the first light source 215. In an exemplary embodiment, the backlight 210 includes a plurality of the first light sources 215 and a plurality of the second light sources 216. In addition, the backlight driver 210 applies a driving voltage 250, which includes a first backlight driving voltage 255 and a second backlight driving voltage 256, to the first light source 215 and the second light source 216, respectively, to drive the first light source 215 and the second light source 216. In an alternative exemplary embodiment, the first backlight driving voltage 255 and the second backlight driving voltage 256 may be provided separately to the backlight 210, e.g., as separate signals from the backlight driver 200. To compensate for the brightness of the first light sources 215, the backlight driver 200 applies the second backlight driving voltage 256 to the second light sources 216 after controlling a voltage level of the second backlight driving voltage 256.

More specifically, the backlight driver 200 applies the first backlight driving voltage 255 to the first light sources 215 to turn the first light sources 215 on and off in each of a first communication period P1 and a second communication period P2 (of a plurality of communication periods) for the visible light communication. Each of the first communication period P1 and the second communication period P2 indicates a time interval to transmit the data by the visible light communication. As shown in FIG. 4, the first backlight driving voltage 255 includes turn-on periods 271, during which the first light sources 215 are turned on to represent a first signal, and turn-off periods 273, during which the first light sources 216 are turned off to represent a second signal. In addition, to compensate for the brightness of the first light sources 215, the second backlight driving voltage 256 includes turn-on periods 281, during which the second light sources 216 are turned on, and turn-off periods 283, during which the second light sources 216 are turned off, as shown in FIG. 5. In an exemplary embodiment, the first backlight driving voltage 255 has a frequency different from a frequency of the second backlight driving voltage 256, as shown in comparing FIGS. 4 and 5. In an exemplary embodiment, for example, the first backlight driving voltage 255 has frequency of a few mega hertz (MHz) and the second backlight driving voltage 256 has a frequency of a few tens of MHz.

The backlight driver counts a number of the turn-on periods 271 of the first backlight driving voltage 255 in each of the first communication period P1 and the second communication period P2. Then, the backlight driver compares the number of the turn-on periods 271 of the first backlight driving voltage 255 with a reference number of times, set for each of the first communication period P1 and the second communication period P2, to control a time interval of the turn-on periods 281 (FIG. 5) of the second backlight driving voltage 256. Thereafter, the backlight driver 200 applies the second backlight driving voltage 256 to the second light sources 216 (FIG. 1). In an exemplary embodiment, the reference number of times indicates a number of times that the light emitted from the backlight 210 has a predetermined average brightness during each of the first communication period P1 and the second communication period P2. For example, when the reference number of times is 10 and the number of the turn-on periods 271 of the first backlight driving voltage 255 is 3 during the first communication period P1 for the visible light communication, as shown in FIG. 4, the backlight driver 200 controls a time interval of the turn-on periods 281 (FIG. 5) of the second backlight driving voltage 256 based on a difference (e.g., 7, which is 10 minus 3) between the number of the turn-on periods 271 of the first backlight driving voltage 255 (e.g., 3) and the reference number of times (e.g., 10).

In addition, the backlight driver 200 controls the second backlight driving voltage 256 using light amount information of the first light sources 215. More particularly, the backlight driver 200 receives brightness information, for example, of the light from an external receiver (not shown) positioned at a front side of the display apparatus 50 by receiving light emitted from the first light sources 215. Accordingly, the backlight driver 200 controls the time interval of the turn-on periods 281 of the second backlight driving voltage 256 based on a difference between a reference brightness, which is a predetermined value set such that the light from the first light sources 215 has the average brightness, and the brightness of the light emitted from the first light sources 215 during each of the first communication period P1 and the second communication period P2.

More specifically, to compensate for non-uniform brightness of the first light sources 215 during the first communication period P1 and the second communication period P2, the backlight driver 200 compensates for the non-uniform brightness of the first light sources 215 using the second light sources 216 operated at a different frequency from the first light sources 215. Thus, the backlight driver 200 applies the first backlight driving voltage 255 to the first light sources 215 and the second backlight driving voltage 256 to the second light sources 216 such that a sum of brightness of light from the first light sources 215 is substantially equal to a sum of brightness of light from the second light sources 216 during each of the first communication period P1 and the second communication period P2.

Additionally, to increase a transmission distance of the data communicated via the visible light communication, the backlight driver 200 according to an exemplary embodiment controls a voltage level of the turn-on periods 271 of the first backlight driving voltage 255 such that the voltage level of first backlight driving voltage 255 is inversely proportional to a duty ratio of the turn-on periods 271 of the first backlight driving voltage 255 during the first communication period P1 and the second communication period P2. More specifically, for example, the backlight driver 200 decreases an applying time of the turn-on periods 271 of the first backlight driving voltage 255 and increases the voltage level of the turn-on periods 271 of the first backlight driving voltage 255, such that an intensity of the light emitted from the first light sources 215 during the first communication period P1 increases. Accordingly, the light emitted from the backlight 210 and provided to the user is maintained at a uniform brightness during both the first communication period P1 and the second communication period P2. In addition, the light emitted from the backlight 210 is provided to the external receiver (not shown) at an increased intensity, thereby substantially increasing the transmission distance of the data.

Figure 6:
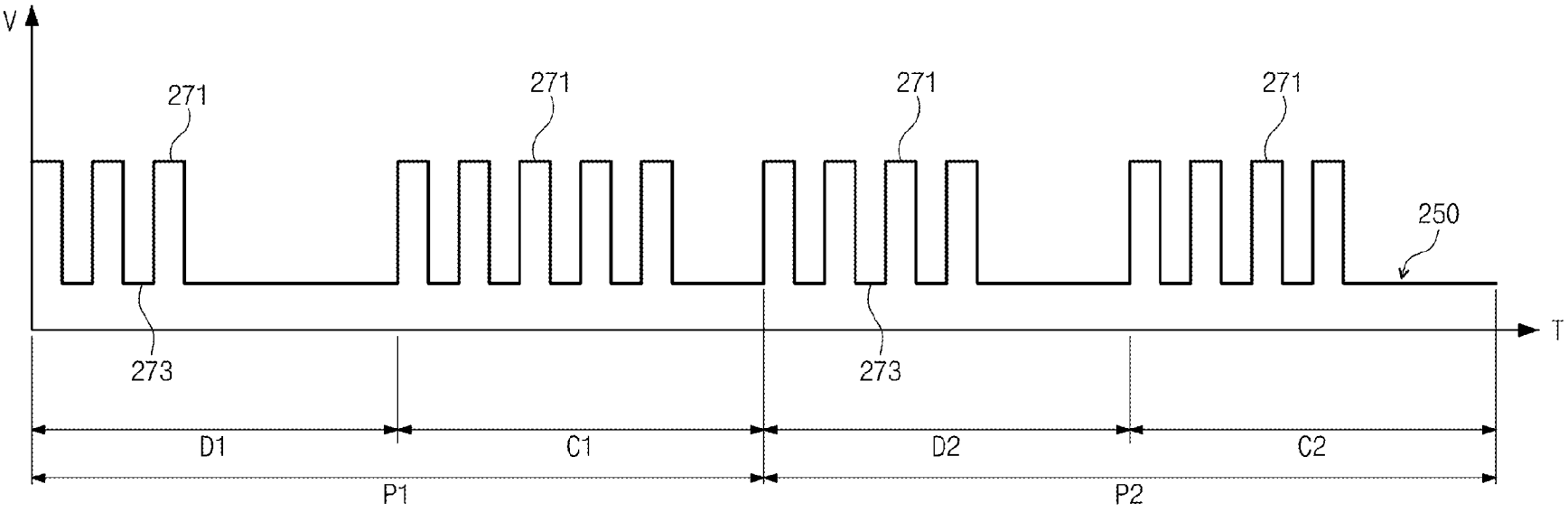
FIG. 6 is a signal timing diagram illustrating another alternative exemplary embodiment of a backlight driving method according to the present invention.

FIG. 6 is a signal timing diagram illustrating another alternative exemplary embodiment of a backlight driving method according to the present invention. In FIG. 6, a voltage level V and an applying time T of the backlight driving voltage are shown.

Referring to FIGS. 1 and 6, the backlight driver 200 applies a backlight driving voltage 250 to a backlight 210 to be turned on and off during a first communication period P1 and a second communication period P2 of a plurality of communication periods for visible light communication. Each of the first communication period P1 and the second communication period P2 indicates a time interval to transmit data using the visible light communication.

As shown in FIG. 6, the backlight driving voltage 250 includes turn-on periods 271, during which the backlight 210 is turned on, and turn-off periods 273, during which the backlight 210 is turned off. To maintain a predetermined average brightness during the first communication period P1 and the second communication period P2, the first communication period P1 is divided into a first data period D1 and a first brightness compensation period C1, while the second communication period P2 is divided into a second data period D2 and a second brightness compensation period C2. Thus, when a number of the turn-off periods 273 of the first data period D1 and the second data period D2 exceed a predetermined reference number, the first data period D1 and the second data period D2 are converted into, e.g., transition to, the first brightness compensation period C1 and the second brightness compensation period C2, respectively. More particularly, the first brightness compensation period C1 and the second brightness compensation period C2 serve as dummy periods without relation to a data transmission, e.g., periods in which data is not transmitted. Thereafter, e.g., in a subsequent third communication period of FIG. 6 (not shown), the first brightness compensation period C1 and the second brightness compensation period C2 are converted into, e.g., transition to, the first data period D1 and the second data period D2 when the first communication period P1 and the second communication period P2 are again changed.

The backlight driver 200 counts a number of the turn-on periods 271 of the first data period D1 and the second data period D2 to maintain the predetermined average brightness in each of the first communication period P1 and the second communication period P2. Additionally, the backlight driver 200 compares the number of the turn-on periods 271 of the first data period D1 and the second data period D2 with a reference number of times, set for each of the first communication period P1 and the second communication period P2. In an exemplary embodiment, the reference number of times corresponds to a number of times that the light is emitted from the backlight 210 to have the predetermined average brightness during the first communication period P1 and the second communication period P2.

Thus, the backlight driver 200 according to an exemplary embodiment controls the number of the turn-on periods 271 of the first brightness compensation period C1 and the second brightness compensation period C2 based on a difference between the number of the turn-on periods 271 of each of the first data period D1 and the second data period D2 and the reference number of times. More specifically, for example, when the reference number of times for the first communication period P1 is 8 and the number of the turn-on periods 271 of the first data period D1 is 3, the backlight driver 200 controls the number of the turn-on periods 271 of the first brightness compensation period C1 based on a difference between the number of the turn-on periods 271 of the first data period D1 and the reference number of times (e.g., a difference of 5, which is 8 minus 3). Likewise, when the reference number of times for the second communication period P2 is 8 and the number of the turn-on periods 271 of the second data period D2 is 5, the backlight driver controls the number of the turn-on periods 271 of the second brightness compensation period C2 by a difference between the number of the turn-on periods 271 of the second data period D2 and the reference number of times (e.g., a difference of 3, which is 8 minus 5).

Thus, in an exemplary embodiment of a method of driving the backlight 210, the backlight driver 200 reduces a brightness difference occurring when the data are transmitted during the first communication period P1 and the second communication period P2, thereby effectively preventing occurrence of flicker.

Additionally, the backlight driver 200 according to an exemplary embodiment controls the voltage level of the backlight driving voltage 260 such that a magnitude of the backlight driving voltage 250 is inversely proportional to a duty ratio of the turn-on periods 271 during each of the first communication period P1 and the second communication period P2. For example, the backlight driver 200 may decrease the time interval of the turn-on periods 271 and increase the voltage level of the turn-on periods 271, such that a intensity of the light emitted during the first communication period P1 and the second communication period P2 increases. Accordingly, the light emitted from the backlight 210 and provided to the user is maintained at a uniform brightness during both the first communication period P1 and the second communication period P2. In addition, the light emitted from the backlight 210 is provided to the external receiver (not shown) at a high intensity, thereby effectively increasing a transmission distance of the data thereto.

Figure 7:
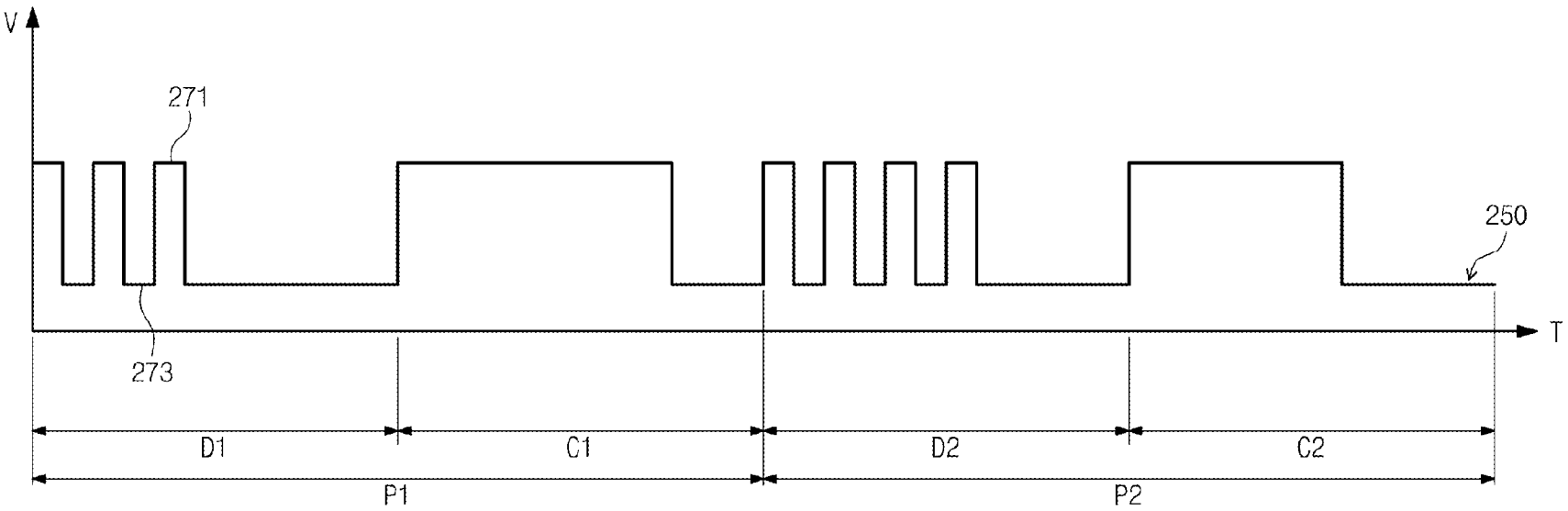
FIG. 7 is a signal timing diagram illustrating yet another alternative exemplary embodiment of a backlight driving method according to the present invention.

FIG. 7 is a signal timing diagram illustrating yet another alternative exemplary embodiment of a backlight driving method according to the present invention. In FIG. 7, the same reference characters refer to the same or like components described above with reference to the exemplary embodiments shown in FIG. 6, and any repetitive detailed explanation thereof will hereinafter be omitted.

Referring to FIGS. 1 and 7, the backlight driver 200 applies a backlight driving voltage 250 to the backlight 200 to turn the backlight 210 on and off during a first communication period P1 and a second communication period P2 of a plurality of communication periods for visible light communication. In an exemplary embodiment, each of the first communication period P1 and the second communication period P2 indicates a time interval to transmit the data by the visible light communication.

The backlight driver 200 counts a number of the turn-on periods 271 of the first data period D1 and the second data period D2 to maintain a predetermined average brightness for each of the first communication period P1 and the second communication period P2. In addition, the backlight driver 200 compares the number of the turn-on periods 271 of the first data period D1 and the second data period D2 with a predetermined reference number of times set for each of the first communication period P1 and the second communication period P2.

Thus, the backlight driver 200 controls a time duration of the turn-on periods 271 of the first brightness compensation period C1 and the second brightness compensation period C2 based on a difference between the number of the turn-on periods 271 of each of the first data period D1 and the second data period D2 and the reference number of times. For example, when the reference number of times of the first communication period P1 is 8 and the number of the turn-on periods 271 of the first data period D1 is 3, the backlight driver 200 controls the time duration of the turn-on periods 271 of the first brightness compensation period C1 based on a difference of 5 (e.g., 8 minus 3) between the number of the turn-on periods 271 of the first data period D1 and the reference number of times. Similarly, when the reference number of times of the second communication period P2 is 8 and the number of the turn-on periods 271 of the second data period D2 is 5, the backlight driver 200 controls the time duration of the turn-on periods 271 of the second brightness compensation period C2 by a difference of 3 (e.g., 8 minus 5) between the number of the turn-on periods 271 of the second data period D2 and the reference number of times.

In addition, the backlight driver 200 may control a voltage level of the backlight driving voltage 250 such that the voltage level of the backlight driving voltage 250 is inversely proportional to a duty ratio of the turn-on periods 271 during each of the first communication period P1 and the second communication period P2. Additionally, an intensity of the light emitted from the backlight 210 may increase, to thereby increase a transmission distance of the data by the visible light communication.

Figure 8:
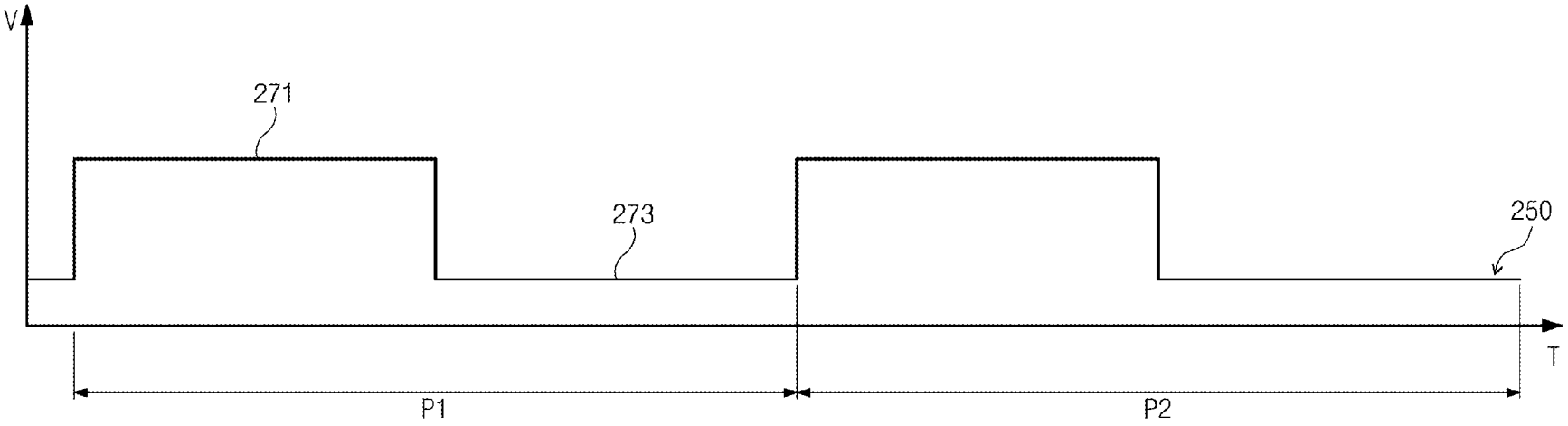
FIGS. 8 and 9 are signal timing diagrams illustrating still another alternative exemplary embodiment of a backlight driving method according to the present invention.
Figure 9:
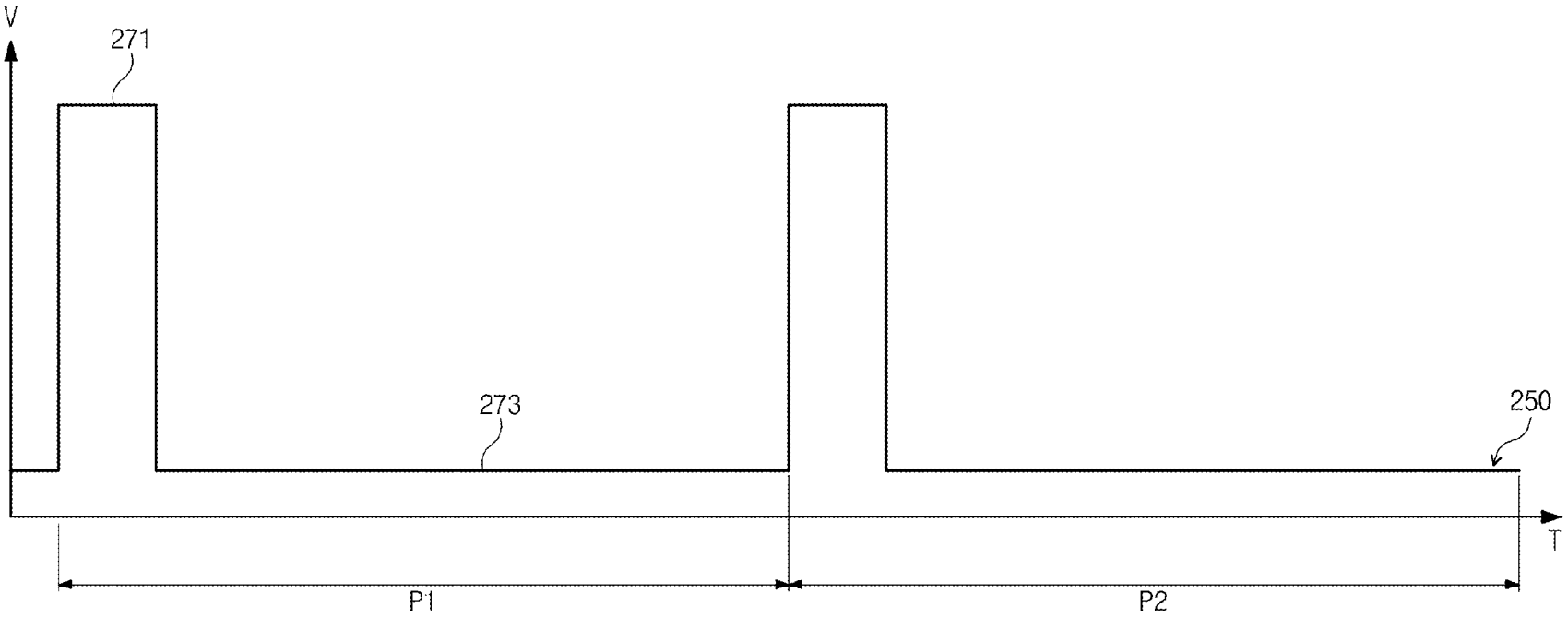

FIGS. 8 and 9 are signal timing diagrams illustrating yet another alternative exemplary embodiment of a backlight driving method according to the present invention. In FIGS. 8 and 9, a voltage level V and an applying time T of the backlight driving voltage are shown.

Referring to FIGS. 1, 8 and 9, the backlight driver 200 according to an exemplary embodiment applies a backlight driving voltage 250 to the backlight 210, which is turned on and off during a first communication period P1 and a second communication period P2 (of a plurality of communication periods) for transmitting data by visible light communication. Each of the first communication period P1 and the second communication period P2 indicates a time interval to transmit the data by the visible light communication. In an exemplary embodiment, the backlight driver 200 drives the backlight 210 in either a first mode or a second mode, during each of which the backlight driving voltage 250 has a different duty ratio.

More specifically, referring to FIGS. 1, 8 and 9, the backlight driver 200 may apply the backlight driving voltage 250 having a first duty ratio to the backlight 210 during the first mode during the first communication period P1 and the second communication period P2. In addition, the backlight driver 200 may apply the backlight driving voltage 250, having a second duty ratio to the backlight 210 during the second mode of each of the first communication period P1 and the second communication period P2.

More particularly, the backlight driving voltage 250 according to an exemplary embodiment includes turn-on periods 271, in which the backlight 210 is turned on during the first communication period P1 and the second communication period P2, and turn-off periods 273, in which the backlight 210 is turned off during the first communication period P1 and the second communication period P2. The backlight driver 200 may apply the backlight driving voltage 250, having the first duty ratio or the second duty ratio less than the first duty ratio, to the backlight 210. Thus, the backlight driver 200 may increase an intensity of light emitted from the backlight 210, for example, by applying the backlight driving voltage 250 having the second duty ratio to the backlight 210. Accordingly, the backlight 210 emits the light having the higher intensity in response to the backlight driving voltage 250 having the second duty ratio (as compared with the light emitted in response to the backlight driving voltage 250 having the first duty ratio).

According to exemplary embodiment of the present invention as described herein, a backlight driver applies a backlight driving voltage having either a first duty ratio or a second duty ratio, different from the first duty ratio, to the backlight according to first and second modes, to thereby maintain an average brightness and varying the light intensity.

Additionally, the display apparatus according to an exemplary embodiment effectively reduces a brightness difference occurring when data are transmitted during communication periods, thereby substantially improving a display quality thereof.

In addition, in an exemplary embodiment, the display apparatus applies a driving voltage having a controlled duty ratio to the backlight, thereby increasing an intensity of light and transmission distance of the same.

The present invention should not be construed as being limited to the exemplary embodiments set forth herein. Rather, these exemplary embodiments are provided so that this disclosure will be thorough and complete and will fully convey the concept of the present invention to those skilled in the art.

For example, it will be noted that, in an alternative exemplary embodiment, in a method of driving a display apparatus including a display panel, a backlight and a backlight driver, the method includes: providing light to the display panel from the backlight in response to a driving voltage; turning the backlight on and off during a communication period to transmit data to an external receiver using visible light communication during the communication period; and controlling a voltage level of the driving voltage with the backlight driver according to a number of turn-on periods of the driving voltage during the communication period.

In another alternative exemplary embodiment, in a method of driving a display apparatus including a display panel, a backlight having a first light source and a second light source, and a backlight driver, the method includes: providing the backlight to the display panel in response to a first driving voltage and a second driving voltage; turning the first light source on and off during a communication period to transmit data to an external receiver using visible light communication during the communication period; compensating a brightness of the first light source using the second light source; and controlling the second driving voltage according to a number of turn-on periods of the first driving voltage during the communication period.

In yet another alternative exemplary embodiment, in a method of driving a display apparatus including a display panel, a backlight and a backlight driver, the method includes: providing light to the display panel in response to a driving voltage; transmitting data to an external receiver using visible light communication by turning on and off the backlight during a communication period, the communication period including a data period, during which the data is transmitted to the external receiver, and a brightness compensation period, during which a brightness of the light is compensated; and controlling the driving voltage during the brightness compensation period according to a number of turn-on periods of the driving voltage in the data period.

In still another alternative exemplary embodiment, in a method of driving a display apparatus including a display panel, a backlight and a backlight driver, the method includes: providing a light to the display panel in response to a driving voltage; transmitting data to an external receiver using visible light communication by turning on and off the backlight during a communication period; driving the backlight during the communication period in one of a first mode during which the driving voltage has a first duty ratio and a second mode during which the driving voltage has a second duty ratio less than the first duty ratio; and controlling a voltage level of the driving voltage such that the voltage level of the driving voltage is inversely proportional to the second duty ratio.

Although the present invention has been particularly shown and described with reference to exemplary embodiments thereof, it will be understood by those of ordinary skill in the art that various changes in form and details may be made therein without departing from the spirit or scope of the present invention as defined by the following claims.

What is claimed is:

1. A display apparatus comprising:

a display panel which receives a light;

a backlight which provides the light to the display panel in response to a first driving voltage and a second driving voltage, the backlight comprising:

a first light source which is turned on and off during a communication period to transmit data to an external receiver using visible light communication during the communication period; and a second light source which compensates a brightness of the first light source; and a backlight driver which controls the second driving voltage according to a number of turn-on periods of the first driving voltage during the communication period and supplies the second driving voltage to the second light source.

2. The display apparatus of claim 1, further comprising a plurality of communication periods, wherein the light is provided to the display panel during two or more communication periods of the plurality of communication periods, and the light has a uniform brightness during the two or more communication periods.

3. The display apparatus of claim 1, wherein a frequency of the first driving voltage is different from a frequency of the second driving voltage.

4. The display apparatus of claim 2, wherein the backlight driver compares the number of turn-on periods of the first driving voltage in each communication period of the plurality of communication periods with a reference number to control a time duration of a turn-on period of the second driving voltage.

5. The display apparatus of claim 1, wherein the backlight driver receives information corresponding to an amount of light emitted from the first light source from an external source to control the second driving voltage.

6. The display apparatus of claim 1, wherein the backlight driver controls a voltage level of the second driving voltage such that the level of the second driving voltage is inversely proportional to a duty ratio of the turn-on periods of the first driving voltage during the communication period.

7. A display apparatus comprising:

a display panel which receives a light;

a backlight which provides the light to the display panel in response to a driving voltage, the backlight being turned on and off during a communication period to transmit data to an external receiver using visible light communication during the communication period, the communication period including a data period, during which the data is transmitted to the external receiver, and a brightness compensation period, during which a brightness of the light is compensated; and a backlight driver which controls the driving voltage during the brightness compensation period according to a number of turn-on periods of the driving voltage in the data period and applies the driving voltage to the backlight.

8. The display apparatus of claim 7, further comprising a plurality of communication periods, wherein the light is provided to the display panel during two or more communication periods of the plurality of communication periods, and the light has a uniform brightness during the two or more communication periods.

9. The display apparatus of claim 8, wherein the backlight driver compares the number of turn-on periods of the driving voltage in the data period with a reference number to control a time duration of a turn-on period of the driving voltage in the brightness compensation period.

10. The display apparatus of claim 8, wherein the backlight driver controls a voltage level of the driving voltage such that the voltage level of the driving voltage is inversely proportional to a duty ratio of the turn-on periods during the communication period.

11. A display apparatus comprising:

a display panel which receives a light;

a backlight which provides the light to the display panel in response to a driving voltage, the backlight being turned on and off during a communication period to transmit data to an external receiver using visible light communication during the communication period; and a backlight driver which drives the backlight during the communication period in one of a first mode during which the driving voltage has a first duty ratio and a second mode during which the driving voltage has a second duty ratio less than the first duty ratio, wherein the backlight driver controls a voltage level of the driving voltage such that the voltage level of the driving voltage is inversely proportional to the second duty ratio.

12. The display apparatus of claim 11, further comprising a plurality of communication periods, wherein the light is provided to the display panel during two or more communication periods of the plurality of communication periods, and the light has a uniform brightness during the two or more communication periods.

13. A method of driving a display apparatus including a display panel, a backlight and a backlight driver, the method comprising:

providing light to the display panel from the backlight in response to a driving voltage;

turning the backlight on and off during a communication period to transmit data to an external receiver using visible light communication during the communication period; and controlling a voltage level of the driving voltage with the backlight driver according to a number of turn-on periods of the driving voltage during the communication period.

14. A method of driving a display apparatus including a display panel, a backlight having a first light source and a second light source, and a backlight driver, the method comprising:

providing the backlight to the display panel in response to a first driving voltage and a second driving voltage;

turning the first light source on and off during a communication period to transmit data to an external receiver using visible light communication during the communication period;

compensating a brightness of the first light source using the second light source; and controlling the second driving voltage according to a number of turn-on periods of the first driving voltage during the communication period.

15. A method of driving a display apparatus including a display panel, a backlight and a backlight driver, the method comprising:

providing light to the display panel in response to a driving voltage;

transmitting data to an external receiver using visible light communication by turning on and off the backlight during a communication period, the communication period including a data period, during which the data is transmitted to the external receiver, and a brightness compensation period, during which a brightness of the light is compensated; and controlling the driving voltage during the brightness compensation period according to a number of turn-on periods of the driving voltage in the data period.

16. A method of driving a display apparatus including a display panel, a backlight and a backlight driver, the method comprising:

providing a light to the display panel in response to a driving voltage;

transmitting data to an external receiver using visible light communication by turning on and off the backlight during a communication period;

driving the backlight during the communication period in one of a first mode during which the driving voltage has a first duty ratio and a second mode during which the driving voltage has a second duty ratio less than the first duty ratio; and controlling a voltage level of the driving voltage such that the voltage level of the driving voltage is inversely proportional to the second duty ratio.

* * * * *